United States Patent [19]

Metcalf

[11] Patent Number: 5,016,352

[45] Date of Patent: May 21, 1991

[54] SINGLE BUTTON RAZOR

[75] Inventor: Stephan C. Metcalf, Waltham, Mass.

[73] Assignee: The Gillette Company, Boston, Mass.

[21] Appl. No.: 498,259

[22] Filed: Mar. 22, 1990

[51] Int. Cl.[5] ..... B26B 21/26; B26B 21/00; B26B 21/14

[52] U.S. Cl. ..... 30/85; 30/47; 30/89

[58] Field of Search ..... 30/40.1, 47, 50, 85, 30/87, 29

[56] References Cited

U.S. PATENT DOCUMENTS

| | | | |
|---|---|---|---|
| 1,961,236 | 7/1931 | Merrick | 30/12 |
| 3,317,995 | 5/1967 | Bord | 30/87 |
| 3,593,416 | 7/1971 | Edson | 30/50 |
| 4,026,016 | 5/1977 | Nissen | 30/47 |
| 4,083,104 | 4/1978 | Nissen et al. | 30/89 |
| 4,168,571 | 9/1979 | Francis | 30/47 |
| 4,198,746 | 4/1980 | Trotta | 30/47 |
| 4,253,235 | 3/1981 | Jacobson | 30/47 |
| 4,253,236 | 3/1981 | Jacobson | 30/47 |
| 4,253,237 | 3/1981 | Jacobson | 30/89 |
| 4,266,340 | 5/1981 | Bowman | 30/89 |
| 4,281,455 | 8/1981 | Dixon et al. | 30/47 |
| 4,428,116 | 1/1984 | Chen | 30/47 |
| 4,514,904 | 5/1985 | Bond | 30/87 |
| 4,658,505 | 4/1987 | Williams | 30/47 |
| 4,739,553 | 4/1988 | Lazarchik | 30/47 |
| 4,756,082 | 7/1988 | Apprille, Jr. | 30/89 |
| 4,785,534 | 11/1988 | Lazarchik | 30/50 |

*Primary Examiner*—Douglas D. Watts
*Assistant Examiner*—Paul M. Heyrana, Sr.
*Attorney, Agent, or Firm*—Owen J. Meegan; Aubrey C. Brine; John P. Morley

[57] ABSTRACT

An improved razor head for attachment to a razor handle comprising a pair of inwardly directed fingers for engagement with a pivotable razor cartridge is provided with a single button for attachment of the razor head to the cartridge. The button is positioned for ease of operation by the thumb when the razor handle is grasped by the user and pressure on the button is effective to move the fingers linearly outwardly along a line parallel to the cartridge width dimension, or razor edge. The fingers are locked in the outward, or open, position after release of the pressure on the button and are returned to the inward or engaging position through contact of the cartridge with a cam follower on the razor head.

10 Claims, 4 Drawing Sheets

SINGLE BUTTON RAZOR

BACKGROUND OF THE INVENTION

The present invention relates to a razor handle for detachably supporting a pivotable razor cartridge and more particularly to an improved razor head having a single button to effect engagement and disengagement of a cartridge from the razor handle. The razor cartridge employed with the present razor handle may be of any type well known in the art having a pair of spaced lugs disposed on its rearward face provided with recesses for receiving a pair of fingers, about which the cartridge pivots about an axis aligned with the blade edge.

A number of razor handles are available on the market which are designed to receive a cartridge releasably attached to the razor and pivotable about an axis parallel to the razor edge. Razors of this type are to be found in U.S. Pat. Nos. 4,026,016 issued May 31, 1977, 4,198,746 issued Apr. 26, 1980, 4,253,237 issued Mar. 3, 1981, 4,253,236 issued Mar. 3, 1981 and 4,253,235 issued Mar. 3, 1981, all assigned to the assignee of the present invention. While this type of razor has gained popularity and various modifications have achieved commercial success, a need has arisen for a razor of this type which is simple in construction, containing a minimum number of parts which substantially inhibits misloading and unintentional cartridge removal, and which is more simple to actuate than those of the prior art.

In the various razor handle constructions of the type under consideration, the pair of fingers which are urged outwardly or in the alternative, inwardly, to contact the blade cartridge are in many instances operated by a plurality of elements which may be difficult to assemble and susceptible to failure during operation. In the more simple constructions, the fingers are often moved arcuately into and out of engagement with the engaging recesses of the cartridge, often making it difficult for the user to determine whether there is a positive engagement between the razor head and the cartridge. In U.S. Pat. No. 4,514,904, issued May 7, 1985, a more simple construction is shown wherein the fingers are moved linearly along a line parallel with the razor edge. However, a pair of buttons are provided, one on each side of the razor heead to accomplish linear movement of the fingers. Such two button construction may provide difficulty in operation of the razor handle to attach or detach the razor cartridge by employing only one hand.

It is therefore an object of the present invention to provide a razor handle having an improved razor head wherein a pair of fingers employed for attaching a pivotable razor cartridge are actuated along a line parallel to the razor edge for more positive attachment of the razor handle to the cartridge.

A further object of the invention is to provide a razor head of the type described which is operable by a single button allowing for one-handed operation of the razor handle in attachment or detachment with a razor cartridge.

Yet another object of the invention is to provide a razor head of the type described containing a minimal number of elements for reliability and ease of assembly.

Still another object of the invention is to provide a razor of the type disclosed which is simple in construction due to the few parts necessary in assembly and therefore economical to manufacture.

SUMMARY OF THE INVENTION

The above objects and other objectives which will become apparent as the description proceeds are accomplished by providing a razor head for engagement with a blade supporting cartridge comprising a body member having a pair of movable arms extending forward of the body member. Each of the arms have a finger facing inwardly for engagement with a blade supporting cartridge and a unitary button member is movable forwardly toward the pair of movable arms. The razor head is simple in construction in that in addition to the body member and button member, the construction comprises a pair of finger plates, a cam member and a spring means forming the actuating elements of the razor head.

The body member has an upwardly facing laterally extending surface and a pair of upwardly extending guide blocks, one disposed adjacent each side of the surface. A pair of slots are formed in the surface, one adjacent each of the guide blocks and the slots extend linearly from the adjacent the rear of the surface to adjacent the front of the surface.

The finger plates each have a surface mating with the body member surface, and are disposed at opposite sides of the body member surface. Each of the plates comprises a first slotted opening formed therein extending laterally and disposed in registration with a mating guide block and a second slotted opening having a rearward portion thereof in registration with a body surface slot and a forward portion thereof extending inwardly of the body surface slot. Each of the finger plates further comprises an arm extending forwardly of a respective finger plate, the arm having a finger facing inwardly for engaging the blade supporting cartridge.

The button member comprises a pair of laterally extending arms, each arm having a downwardly extending pin extending through a rearward portion of the second slotted opening in the finger plate and into a respective slotted opening in the body member surface. The button member is movable in a forward direction whereby each of the pins remain extending through a second slotted opening and into a respective slotted opening in the body member surface during forward and rearward movement of the button to thereby move the fingers in an inward and outward direction respectively along the line parallel to the slots formed in the body member surface.

The cam member has a pair of outwardly facing opposed surfaces, each for engaging with an inwardly facing surface of a respective finger plate. A cam surface extends forwardly of the body member for contacting the blade supporting cartridge when the opposed outwardly facing surfaces are in engagement with a respective finger plate surface whereby the contact with the blade supporting cartridge, accompanied by sufficient pressure to move the cartridge into position for engagement with the finger plate fingers, is effective to move the cam surface rearwardly against the spring means and disengage the cam member outwardly facing surfaces from a mating finger plate surface.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
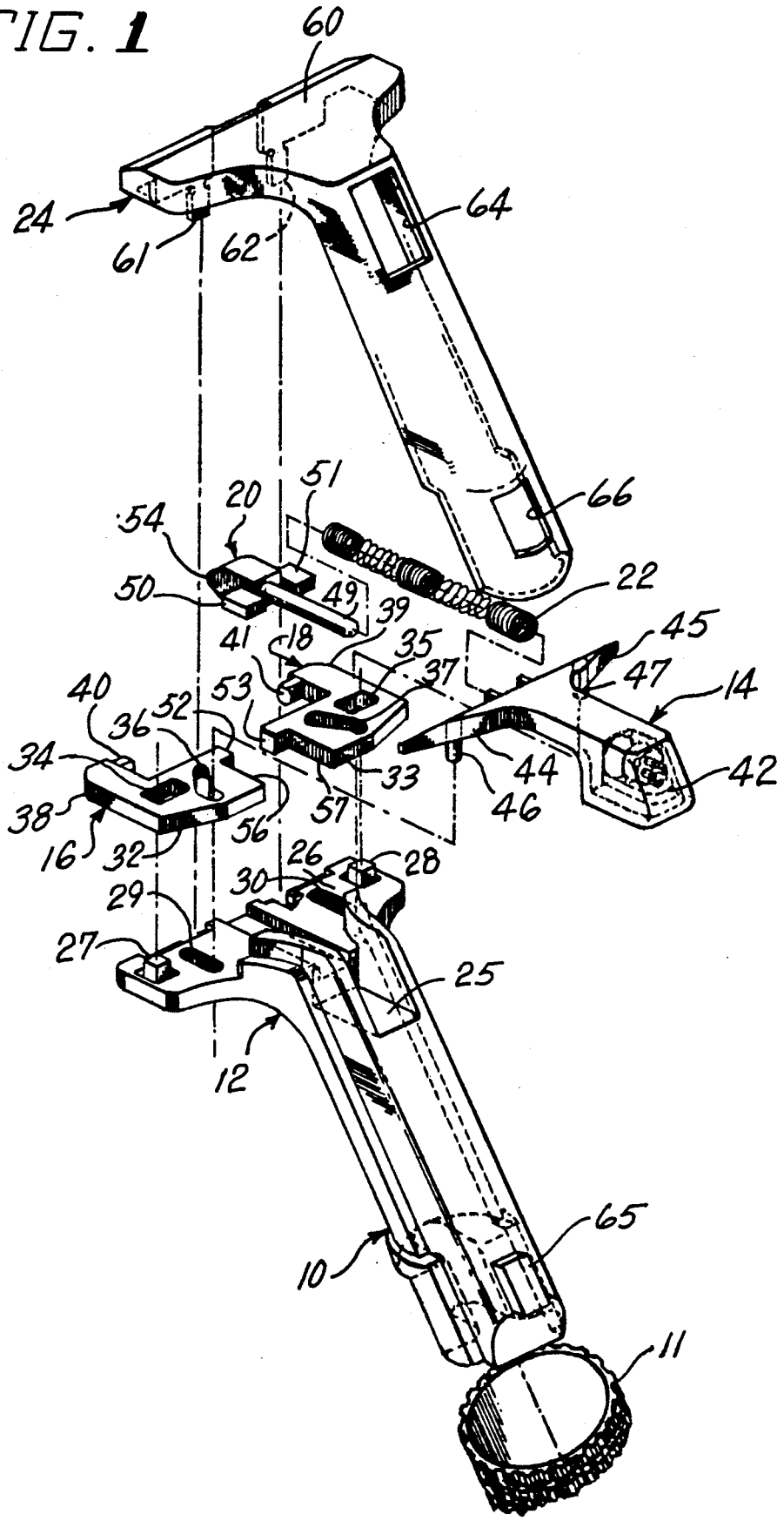
FIG. 1 is a perspective exploded view showing a razor constructed in accordance with the teachings of the present invention.
Figure 2:
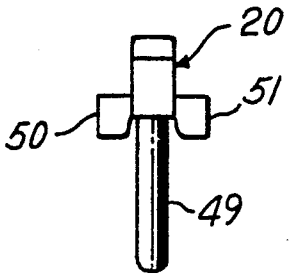
FIG. 2 is a top plan view showing details of an element of the construction of FIG. 1.
Figure 3:
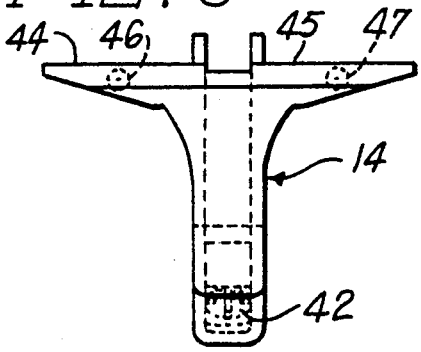
FIG. 3 is a top plan view showing details of another element of the razor handle of FIG. 1.
Figure 4:
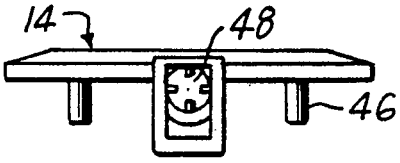
FIG. 4 is a front elevational view showing further details of the element of FIG. 3.
Figure 5:
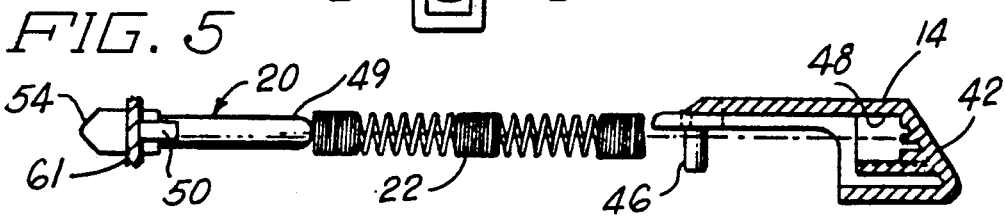
FIG. 5 is a side elevational view showing a partial assembly of the construction of FIG. 1.

Referring now the drawing and in particular to FIGS. 1 through 5, there is shown a razor head 10 adapted for assembly onto a razor handle 11 having a body portion 12. The razor head 10 further comprises a button member 14, a pair of finger plates 16 and 18, a cam follower 20, a spring 22 and a cover plate 24 for retaining the assembly of the razor head 10 in position when attached to the razor handle 11.

Figure 6:
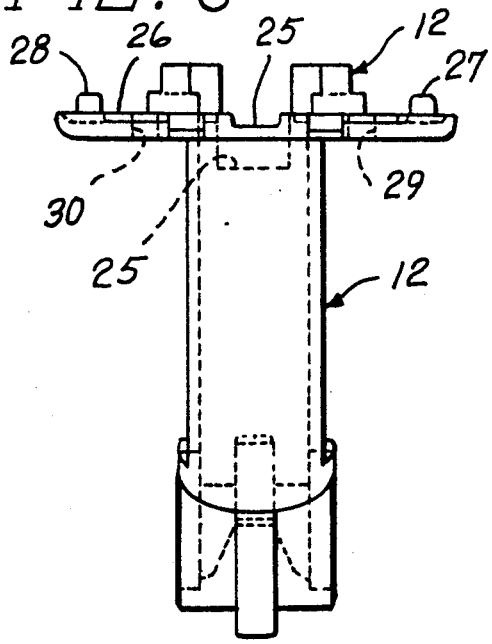
FIG. 6 is a front elevational view showing details of the body member of the structure of FIG. 1.

As best shown in FIGS. 1 and 6, the body member 12 has a centrally disposed stepped groove 25 formed therein for receiving the button 14 and an upwardly facing laterally extending surface 26 for receiving the finger plates 16 and 18 in registry therewith. A pair of upwardly extending guide blocks 27 and 2 are disposed adjacent opposite sides of the surface 26 and a pair of slots 29 and 30 are formed in the surface 26, one adjacent each of the guide blocks 27 and 28, the slots extending rearwardly from adjacent the rear of the surface to adjacent the front of the surface.

Each of the fingers plates 16 and 18 comprises a downwardly facing surface 32 and 33 respectively for registry with the laterally extending surface 26 of the body portion 12. Each finger plate 16 and 18 further comprises a first slotted opening 34 and 35 respectively extending laterally and disposed in registration with a mating guide block 27, 28 with the razor head 10 in the assembled condition. A second slotted opening 36 and 37 is formed in each of the respective guide plates 16 and 18, the second slotted opening 36 and 37 having a rearward portion thereof in registration with a body member surface slot 29 and 30 and a forward portion thereof extending inwardly of the respective body member surface slot.

It will further be observed that each of the finger plates 16 and 18 comprises a pair of arms 38 and 39 respectively extending forwardly of the finger plate and having a finger 40 and 41 respectively facing inwardly for engaging a blade supporting cartridge (not shown).

The button member 14 comprises a rearwardly facing pressure surface 42 and a pair of laterally extending arms 44 and 45, each having a downwardly projecting pin 46 and 47 respectively for extending through a rearward portion of a slotted opening 36 or 37 respectively in a finger plate and into a respective slot 29 or 30 in the body portion 12.

As best shown in FIGS. 1 and 3 through 5, the button member 14 has a cylindrical opening 48 formed therein for receiving the spring 22 and the forward end of the spring is dimensioned to receive the cylindrical shaped rod 49 extending rearwardly from the cam follower 20. The cam follower 20 further comprises a pair of opposed outwardly facing surfaces 50 and 51, each disposed for registration with an inwardly facing surface 52 and 53 disposed on a respective finger plate 16 and 18. The cam follower 20 further comprises a cam surface 54 extending forwardly of said body portion 12 for contacting a blade supporting cartridge when the surfaces 50 and 51 are in contact with the surfaces 52 and 53 of the finger plates 16 and 18.

In assembly of the razor head 10, the finger plates 16 and 18 are disposed on the body member 10 with the surface 32 in registration with the surface 26 and the finger plate 18 is disposed at the opposite side of the body portion 12 with the surface 33 in registration with the surface 26, the guide block 26 extending through the slotted opening 34 and the guide block 28 extending upwardly through the slotted opening 35. The finger plates 16 and 18 are moved until the rear portions of the slotted opening 36 and 37 are in alignment with the slots 29 and 30 and the button member is placed into the assembly with the button extending into the stepped groove 25 and the pins 46 and 47 projecting downwardly through the slotted opening 36 and 37 into the slots 29 and 30. The spring 22 is placed through the assembly by inserting one end into the cylindrical opening 48 of the button member 14 and the rod 49 is inserted into the forward end of the spring and placed into the assembly with the surfaces 50 and 51 lying adjacent the surfaces 56 and 57 of the finger plates 16 and 18.

Figure 10:
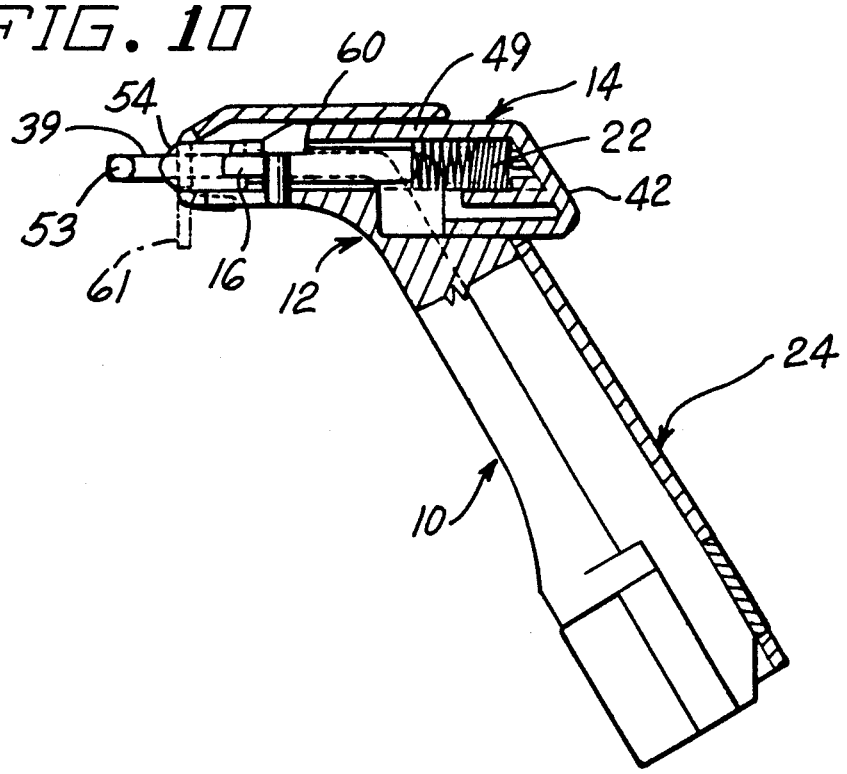
FIG. 10 is a side elevational view showing the structure of FIG. 7.
Figure 11:
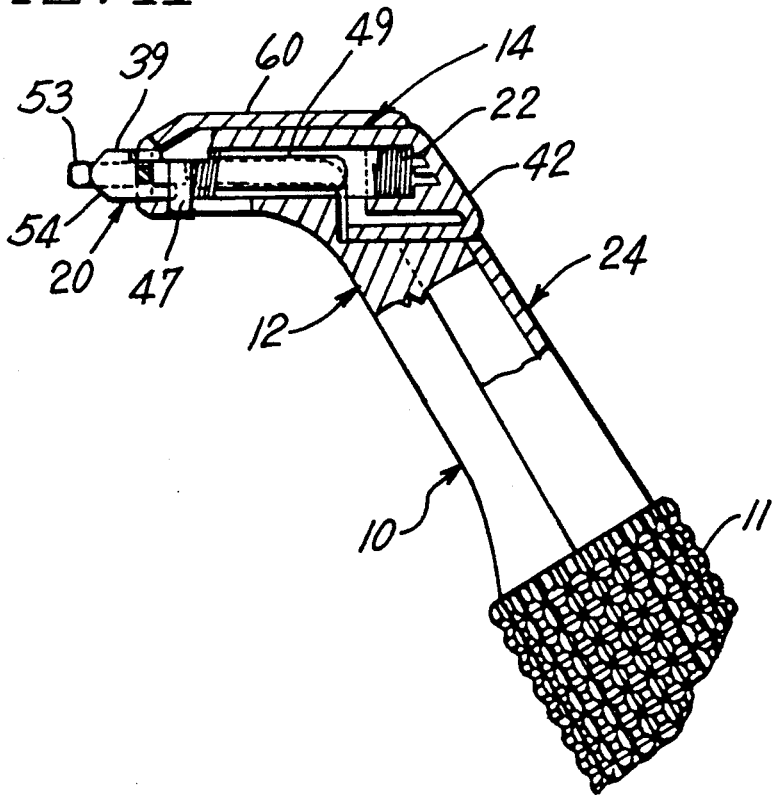
FIG. 11 is a side elevational view similar to FIG. 10 showing the structure of FIG. 8.

The cover plate 24 is now placed over the assembly having a top plate 60 for retaining the above described elements in position and a pair of tabs 61 and 62 are bent rearwardly to the underside of the body member 12. When so positioned, a rectangular opening 64 is disposed such that the pressure surface 42 of the button member 14 extends rearwardly through the cover plate 24 and a rectangular detent 65 disposed on the body portion 12 extends through a second rectangular opening 66 formed in the cover plate. With the structure thus assembled, as best shown in FIG. 10, the latter most portion of the razor head 10 with the cover plate 24 in position is pressed into the opening of the handle 11 to complete the simplified construction. It will be appreciated that the minimum number of steps required, and the lack of need for soldering or other fastening techniques provides an extremely simple construction which is easily assembled in a minimum period of time.

Figure 7:
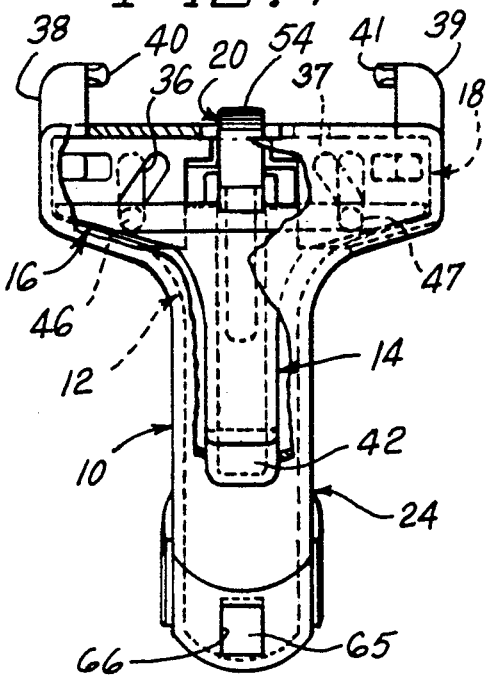
FIG. 7 is a top plan view partially in section showing the structure of FIG. 1 in its assembled form.
Figure 8:
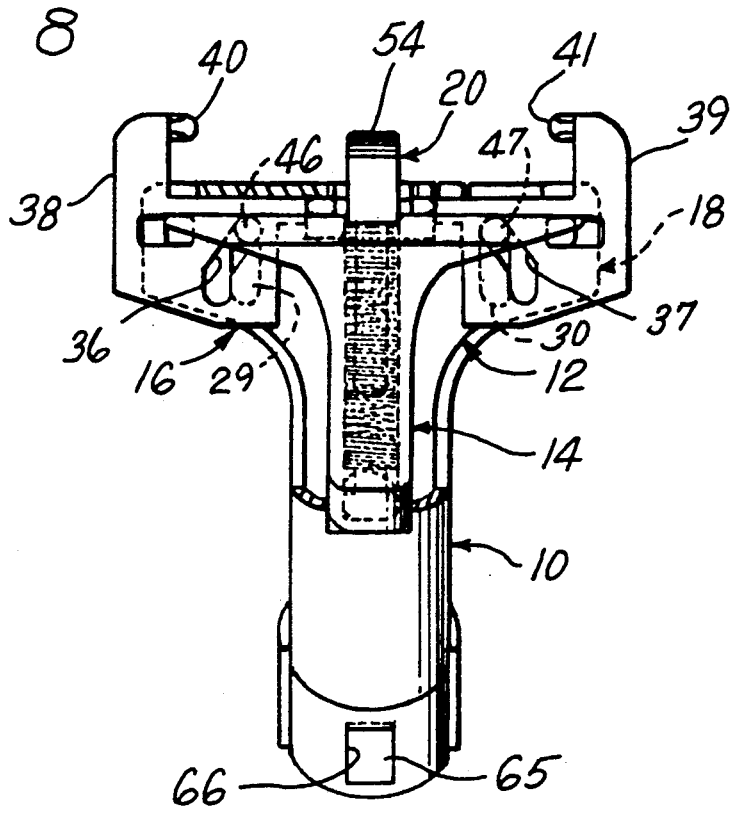
FIG. 8 is a top plan view similar to FIG. 7 showing the structure of FIG. 7 during operation thereof.
Figure 9:
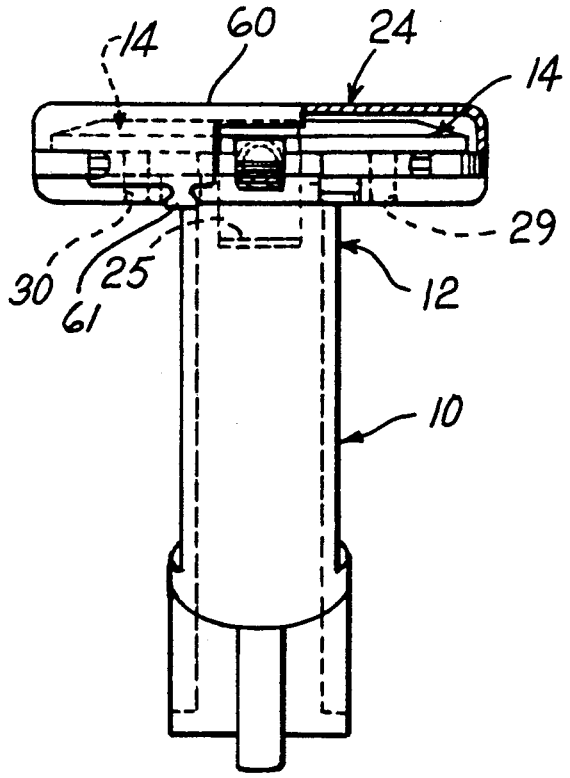
FIG. 9 is a front elevational view showing the assembly of FIGS. 7 and 8.

Referring now to FIGS. 7 and 8, the razor head 10 is shown therein in its operative positions wherein a blade supporting cartridge is held between the arms 38 and 39 with the fingers 40 and 41 engaging a blade supporting cartridge (FIG. 7) and in a position wherein the blade supporting cartridge is released from, or is about to be received onto the razor head 10 (FIG. 8).

With the razor head 10 in the assembled position, as shown in FIG. 7, the cam surface 54 of the cam follower 20 is disposed in its retracted position with the spring 22 in compression and the fingers 40 and 41 in the inward most position. The pressure surface 42 of the button member 14 extends to its rear most position through the opening 64 in the cover plate 24. To eject a blade supporting cartridge from the razor head 10 and engage a new cartridge, the button member 14 is moved forwardly to the position shown in FIG. 8. During movement of the button member 14 to its forward-most position, the pins 46 and 47 move into the portion of the slotted openings 36 and 37 which are directed inwardly, and the retaining of the pins 46 and 47 in the slots 29 and 30 cause the arms 38 and 39 to move outwardly from the cartridge maintaining their alignment perpendicular to movement of the button 14, and parallel to an edge at a blade contained in the cartridge. Simultaneously, the cam follower 20 is moved forwardly until the surfaces 50 and 51 are disposed between the finger plates 16 and 18 and in contact with the surfaces 52 and 53, thus locking the arms 38 and 39 in their outward-most position while the cam follower surface 54 is effective to push the cartridge away from the body portion 12.

In this position, the face of the spring 22 disposed between the cam follower 20 and the bottom 14 is attempting to move the button to its original rearmost position. However, retention of the pins 46 and 47 within the slotted openings 36 and 37 would require the finger plates 16 and 18 to move inwardly for this to occur, which movement is prevented by the surfaces 50 and 51.

With the razor head 10 in the position as shown in FIG. 8, a new blade supporting cartridge is assembled to the unit by placing the cam surface 54 in contact with the rear surface of the cartridge forcing the cam follower 20 rearwardly against the bias of the spring 22 and releasing the finger plates 16 and 18 from their locked position by disengaging the finger plate surfaces 52 and 53 from engagement with the surfaces 50 and 51 of the cam follower. This motion causes the fingers 40 and 41 to move linearly towards one another to contact and engage with suitably placed openings in the blade supporting cartridge, and the button member 14 is returned to the position shown in FIG. 7.

Thus, the combination of the locking arrangement, taken with the linear movement of the fingers 40 and 41 is effective to prevent misloading and unintentional cartridge removal in the employment of the razor head 10.

I claim:

1. A razor head for engagement with a blade supporting cartridge comprising:

a pair of finger plates extending forward of said razor head, each said plate having a finger facing inwardly for engagement with a blade supporting cartridge;

a unitary button member movable forwardly toward said pair of finger plates; and means interconnecting said unitary button with said pair of movable arms to cause movement of said fingers in an outwardly and inwardly direction long a substantially straight line which extends substantially at right angles to the movement of the said unitary button.

2. A razor head as set forth in claim 1 further including means interconnecting said unitary button with said pair of arms effective to lock said fingers in an outward position with said unitary button in the forward positions.

3. A razor head as set forth in claim 1 which further comprises an upwardly facing surface and said pair of finger plates disposed on said surface at opposite sides of said surface, each finger plate having a downwardly facing surface mating with said surface for slidable engagement therewith, and each finger plate having one of said arms formed thereon and extending forward of said razor head.

4. A razor head as set forth in claim 3 wherein said unitary button member comprises a pair of laterally extending arms, each having a downwardly projecting pin extending through a slotted opening in a respective finger plate and into a respective slotted opening in said razor head surface, wherein said slotted openings in said razor head surface each extend linearly from adjacent the rear of said surface to adjacent the front of said surface and said slotted openings in each said finger plate comprises a rearward portion thereof in registration with a respective razor head surface slot and a forward portion thereof extending inwardly of said respective razor head surface slot whereby movement of a said downwardly projecting pin forwardly in a said razor head surface slot is effective to move a respective finger plate in a lateral outward direction.

5. A razor head as set forth in claim 4 further including means interconnecting said unitary button with each said finger plate to lock said finger plate in an outward position with said unitary button in the forward position.

6. A razor head as set forth in claim 5 wherein said pair of slots formed in said razor head surface are parallel one with the other.

7. A razor head for engagement with a blade supporting cartridge comprising:

a body member having an upwardly facing laterally extending surface;

a pair of upwardly extending guide blocks, one disposed adjacent said side of said surface;

a pair of slots formed in said surface, one adjacent each of said guide blocks, said slots extending linearly from adjacent the rear of said surface to adjacent the front of said surface;

a pair of finger plates, each having a surface mating with said body member surface and disposed at opposite sides of said body member surface, each of said plates comprising a first slotted opening formed therein extending laterally and disposed in registration with a mating guide block and a second slotted opening having a rearward portion thereof in registration with a body surface slot and a forward portion thereof extending inwardly of said body surface slot, each of said finger plates further comprising an arm extending forwardly of a respective finger plate having a finger facing inwardly for engaging a blade supporting cartridge; and a button member having a rearwardly extending portion comprising of rearwardly facing pressure surface, said button member further comprising a pair of laterally extending arms, each arm having a downwardly projecting pin extending through a rearward portion of a said second slotted opening of a said finger plate and into a respective said slotted opening in said body member surface, said button member being movable in a forward direction whereby each said pin remains extended through a said second slotted opening and into a respective slotted opening during forward and rearward movement of said button to thereby move said fingers in an outward and rearward direction respectively along a line parallel to said slots formed in said body member surface.

8. A razor head as set forth in claim 7 wherein said pair of slots formed in said body member are parallel one with the other and said first slotted openings in said finger plates are disposed perpendicular to said pair of slots and are substantially aligned one with the other.

9. A razor head as set forth in claim 8 further including means interconnecting said unitary button with each said finger plate to lock said finger plates in an outward position with said unitary button in the forward position.

10. A razor head as set forth in claim 9 wherein said locking means interconnecting said unitary button with each said finger plate comprises a cam member interconnected to said unitary button by spring means, said cam member having a pair of opposed outwardly facing surfaces, each for engagement with an inwardly facing surface of a respective finger plate and a cam surface extending forwardly of said body member for contacting a blade supporting cartridge when said opposed outwardly facing surface is in engagement with a respective inwardly facing finger plate surface whereby said contact with a blade supporting cartridge accompanied by sufficient pressure to move the cartridge into position for engagement with said finger plate fingers is effective to move said cam surface rearwardly against said spring means and disengage said cam member surfaces from said finger plate surfaces.

* * * * *